US006450761B2

(12) United States Patent
Lalanne et al.

(10) Patent No.: US 6,450,761 B2
(45) Date of Patent: Sep. 17, 2002

(54) TURBOMACHINE INCLUDING A DEVICE FOR SUPPRESSING VIBRATION CAUSED BY ACOUSTICAL RESONANCE

(75) Inventors: Bernard Lalanne, Pau; René Rodellar, Billére, both of (FR)

(73) Assignee: Turbomeca, Bordes (FR)

( * ) Notice: Subject to any disclaimer, the term of this patent is extended or adjusted under 35 U.S.C. 154(b) by 0 days.

(21) Appl. No.: 09/808,189

(22) Filed: Mar. 15, 2001

(30) Foreign Application Priority Data

Mar. 17, 2000 (FR) ..... 00 03490

(51) Int. Cl.[7] ..... F01D 25/04
(52) U.S. Cl. ..... 415/119; 415/144; 415/206
(58) Field of Search ..... 415/119, 144, 415/206

(56) References Cited

U.S. PATENT DOCUMENTS

| | | | | |
|---|---|---|---|---|
| 4,436,481 A | | 3/1984 | Linder | |
| 4,981,018 A | | 1/1991 | Jones et al. | |
| 5,186,601 A | * | 2/1993 | Treece et al. | 415/173.1 |
| 5,236,301 A | | 8/1993 | Palmer | |
| 5,246,335 A | * | 9/1993 | Mitsubori et al. | 415/214.1 |
| 5,295,785 A | * | 3/1994 | Church et al. | 415/119 |
| 5,314,300 A | | 5/1994 | Gatley, Jr. et al. | |
| 5,399,064 A | | 3/1995 | Church et al. | |
| 5,403,149 A | * | 4/1995 | Arnet et al. | 415/58.6 |
| 6,183,195 B1 | * | 2/2001 | Tremaine | 415/1 |

FOREIGN PATENT DOCUMENTS

| | | |
|---|---|---|
| DE | 197 27 139 A | 1/1993 |
| EP | 0 350 427 A | 1/1990 |
| EP | 0 573 895 A | 12/1993 |
| GB | 1 132 485 A | 11/1968 |

* cited by examiner

*Primary Examiner*—Edward K. Look
*Assistant Examiner*—Igor Kershteyn
(74) *Attorney, Agent, or Firm*—Oblon, Spivak, McClelland, Maier & Neustadt, P.C.

(57) ABSTRACT

A turbomachine includes blade stages on the trajectory of a flow of air or gas delimited by a symmetrical wall along the axis of the turbomachine. The wall has orifices communicating with a cavity outside the flow of air of generally symmetrical structure. The cavity is connected to a pipe. Symmetry degrading arrangements are provided inside the cavity, for example in the form of a portion of tube mounted in the pipe to project partly into the cavity.

10 Claims, 5 Drawing Sheets

TURBOMACHINE INCLUDING A DEVICE FOR SUPPRESSING VIBRATION CAUSED BY ACOUSTICAL RESONANCE

BACKGROUND OF THE INVENTION

1. Field of the Invention

The present invention relates to a turbomachine including a plurality of blade stages on the trajectory of a flow of air or gas.

2. Description of the Prior Art

In this kind of turbomachine, one or more cavities are provided on the outside of the flow of air and communicate with the flow of air via a plurality of orifices formed in a symmetrical wall along the axis of the turbomachine delimiting the flow of air. A pipe including a discharge valve is generally connected to the cavity to sample a portion of the flow of air to be rejected to the outside when the turbomachine is operating under partial load to improve stable operation of the turbomachine or to satisfy an auxiliary demand. The volume of the cavity must therefore be sufficient to enable regular sampling in use.

It is nevertheless found that the air or the gas flowing across the cavity can trigger acoustical resonance in the cavity in some speed ranges because of boundary layer shear.

Such resonance is encouraged by the structure of the cavity, which is generally symmetrical. The cavity can be symmetrical with respect to the axis of the turbomachine or incorporate patterns, bosses or other raised members regularly distributed over its periphery to produce cyclic symmetry. The break in the symmetry caused by the intake of the pipe for sampling air for the discharge valve or for cooling the discs and blades of the turbine of the turbomachine is insufficient for it to be certain that acoustical resonance in the cavity will be prevented.

Acoustical resonance has major drawbacks and can lead to the risk of blades breaking.

The invention therefore relates to a turbomachine including means for eliminating or preventing the generation of rotating acoustical waves in the previously mentioned cavity and therefore suppressing the drawbacks due to acoustical resonance in said cavity.

SUMMARY OF THE INVENTION

The turbomachine in accordance with the invention includes a plurality of blade stages on the trajectory of a flow of air or gas delimited by a symmetrical wall along the axis of the turbomachine, the wall having orifices communicating with a cavity outside the flow of air, of generally axially or cyclically symmetrical structure. Symmetry degrading means are provided inside said cavity.

The symmetry degrading means can take various forms.

In a preferred first embodiment of the invention the symmetry degrading means include a spacer mounted in a pipe connected to the cavity to project partly into the cavity.

The spacer is preferably force-fitted into said pipe to limit vibration in operation.

The spacer can advantageously be a portion of tube force-fitted into said pipe from the outside.

In a second embodiment the symmetry degrading means include a convex localized area of the cavity having its convex side facing towards the inside of the cavity.

The convex area can be obtained by localized stamping of the outside or inside wall of the cavity.

In another embodiment of the invention the symmetry degrading means include a member fixed to the inside face of the outside wall of the cavity at a particular location, for example a portion of sheet metal welded to the inside face of the outside wall of the cavity or to the inside wall of the cavity.

In another embodiment of the invention the symmetry degrading means include a screw passing through the outside wall of the cavity and projecting into the cavity.

The invention will be better understood after reading the following description of embodiments of the invention shown by way of non-limiting example only in the accompanying drawings.

DETAILED DESCRIPTION OF THE PREFERRED EMBODIMENTS

Figure 1:
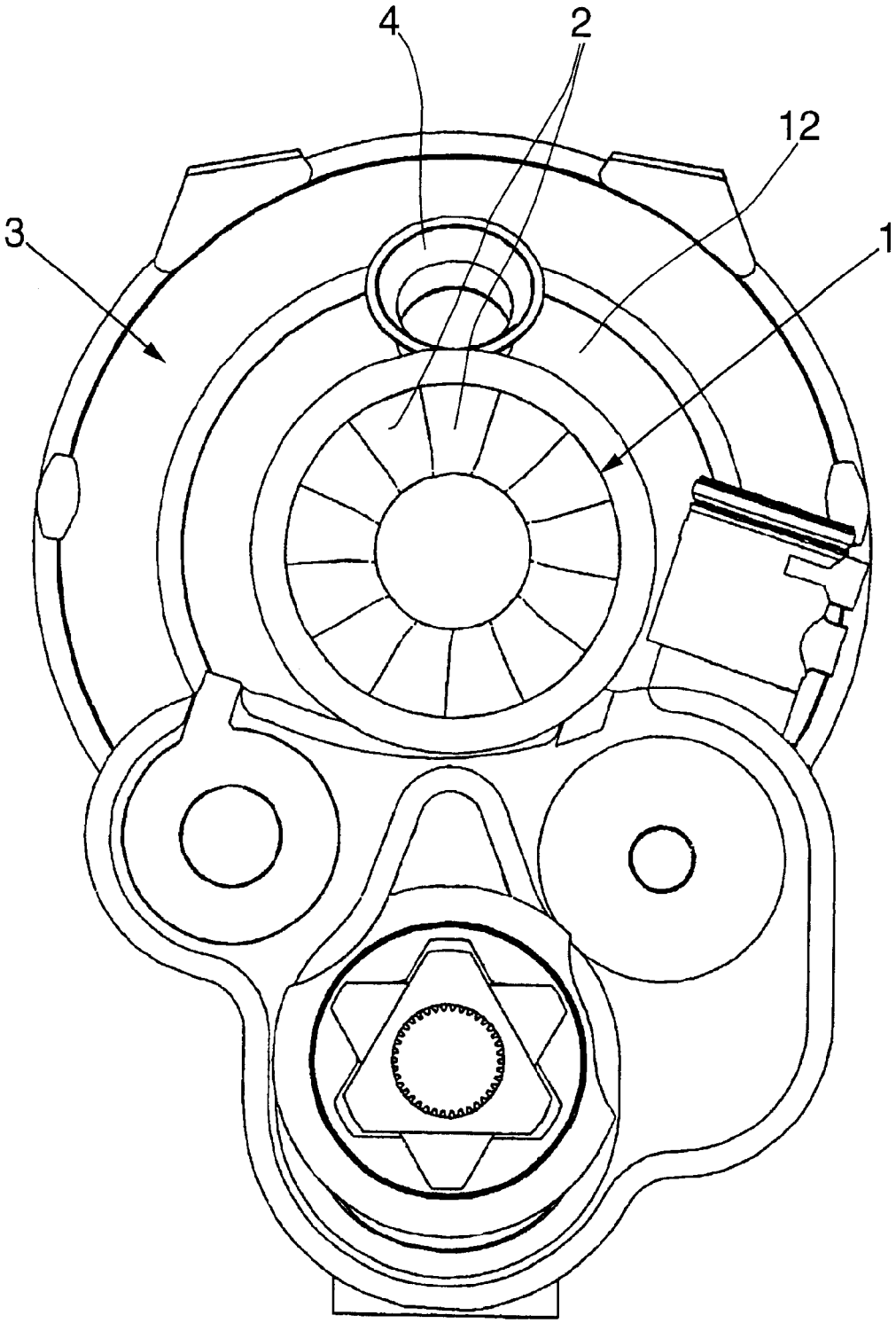
FIG. 1 is an outside lateral view of a turbomachine.
Figure 2:
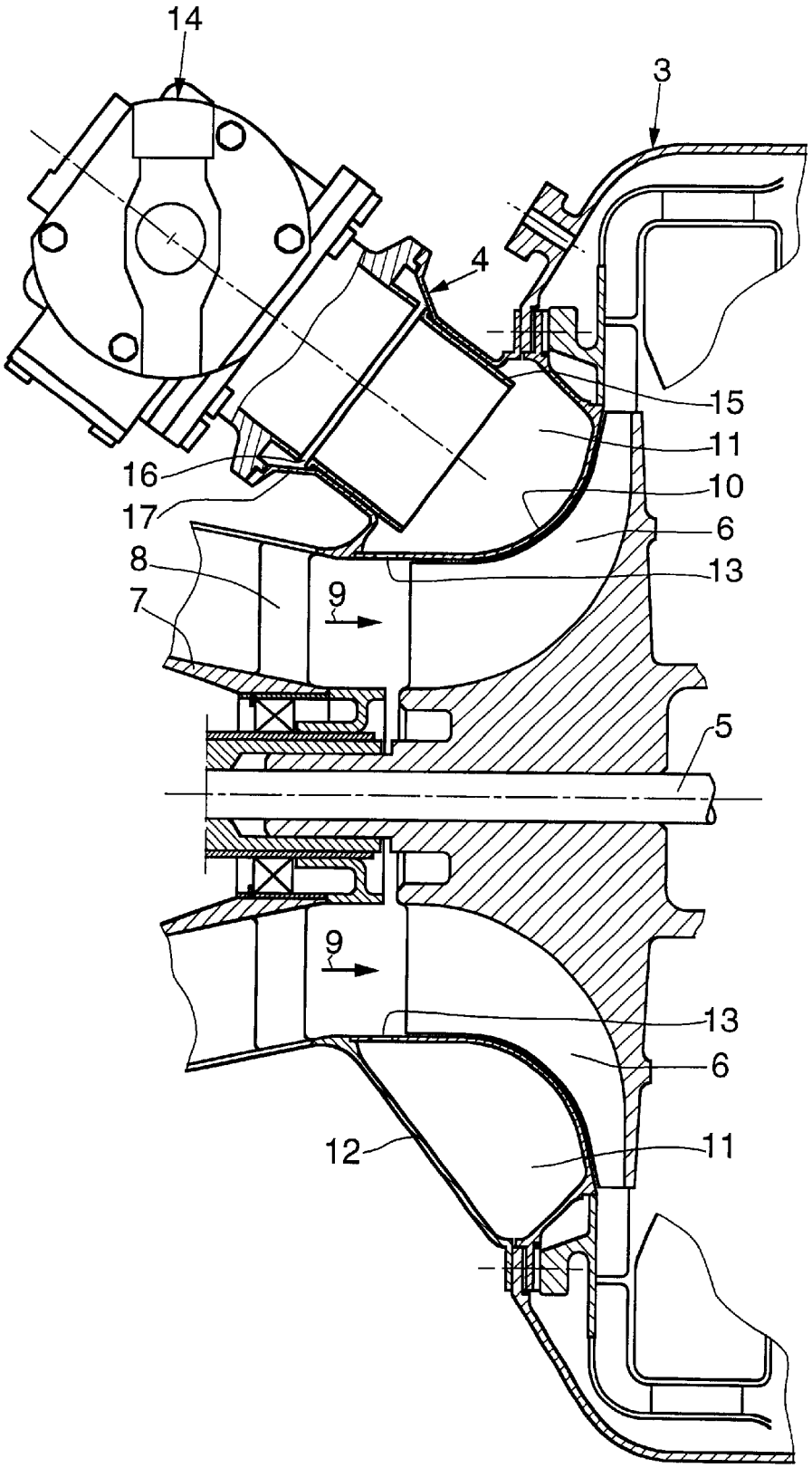
FIG. 2 is a partial sectional view of the turbomachine shown in FIG. 1, showing a first embodiment of the invention.

As shown in FIGS. 1 and 2, the turbomachine in accordance with the invention has an air intake 1 provided with a first set of rotary blades 2.

The outside wall 3 of the turbomachine has a connecting spigot 4 for a pipe for rejecting some of the flow to the surrounding air.

The sectional view of FIG. 2 shows the rotating shaft 5 on which are mounted the rotating blades 6 of a first compressor stage of the turbomachine. The fixed hub 7 has fixed director blades 8. The arrows 9 symbolize the flow of air.

The wall 10 delimits the flow of air on the outside and has a symmetrical configuration with respect to the axis of the turbomachine. A cavity 11 whose structure is also generally symmetrical with respect to the axis of the turbomachine is defined between the wall 10 and an outside wall 12 and substantially at the location of the rotary blades 6. The wall 10 has at its periphery a plurality of orifices 13 establishing communication between the cavity 11 and the flow of air. The orifices 13 can be slots, half-moon shapes or circular grooves. Of course, in different embodiments, the cavity 11 could feature cyclic symmetry, i.e. include a plurality of patterns or other elements regularly disposed inside the cavity and therefore susceptible to cause acoustical resonance in the cavity.

A discharge valve 14 controlled by means that are not shown in the figure can be seen in the FIG. 2 cross-section. The valve 14 is downstream of the spigot 4 which is itself attached to the wall 12 at a particular location in the cavity 11.

When it is open, the discharge valve 14 samples a portion of the flow of air in order to reject it to the exterior so as to improve the operation of the turbomachine under certain loads. When the discharge valve 14 is closed, the flow of air can cause resonance in the cavity 11 because of boundary layer shear on passing over the orifices 13 at speeds in certain ranges.

In accordance with the invention, the generation of rotating acoustical waves in the cavity 11 is prevented by intentionally and greatly degrading the symmetry of the cavity 11 with respect to the axis, over and above the degraded symmetry which already exists because of the presence of the spigot 4.

In the embodiment shown in FIG. 2, the symmetry degrading means include a portion of tube 15 force-fitted into the pipe 4. It is preferably fitted from the outside, the tube portion 15 being pushed in until a radial shoulder 16 on the outside edge of the tube portion 15 abuts against a conical portion 17 of the pipe 4 to define the final position of the tube portion 15.

In this final assembly position, the tube portion 15 partly projects into the cavity 11, beyond the wall 12, but without coming into contact with the inside wall 10. This is to prevent unduly disturbing the flow of air in the cavity 11 when the discharge valve 14 is open.

Figure 3:
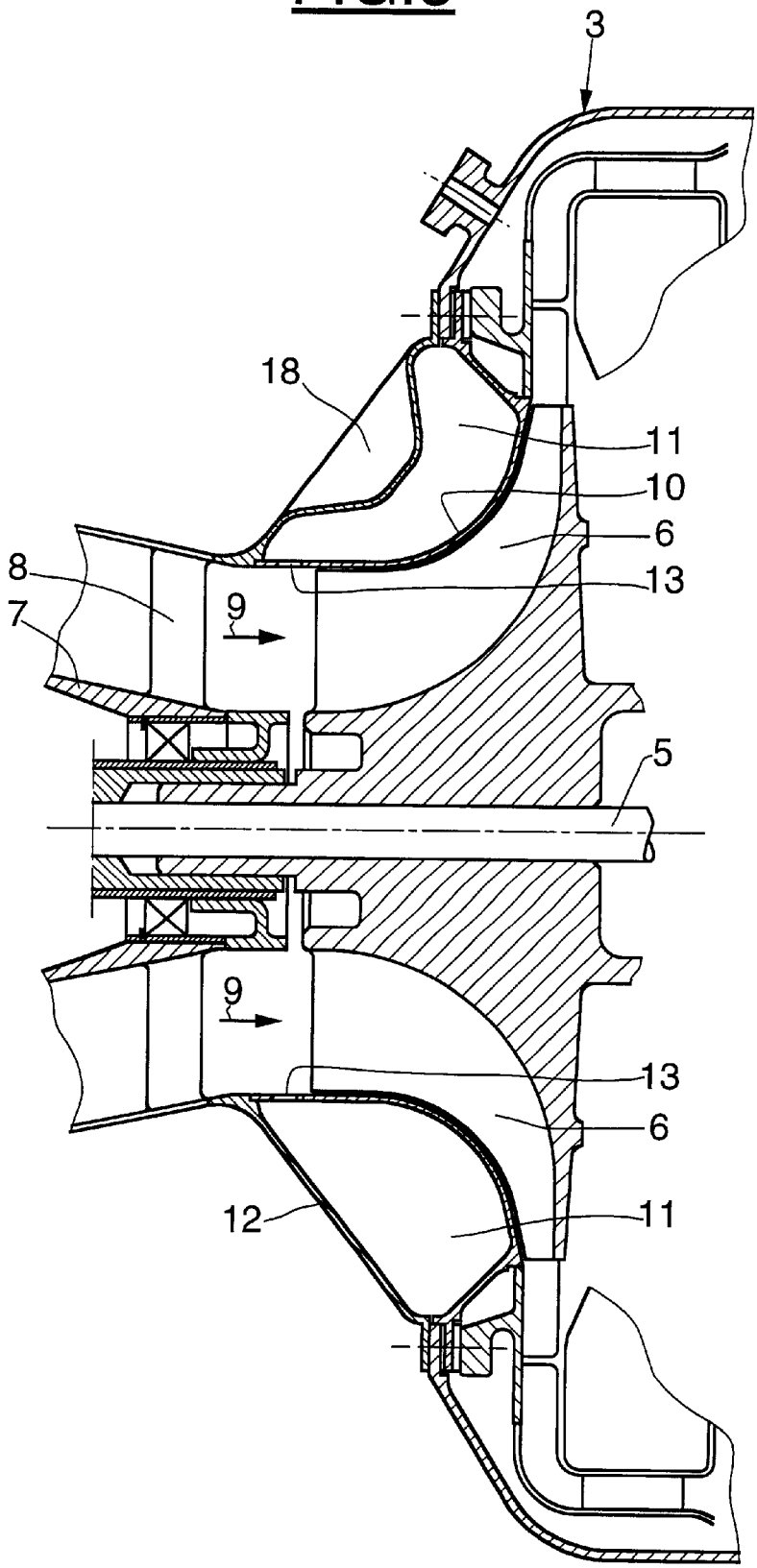
FIG. 3 is a sectional view similar to FIG. 2, showing a second embodiment of the invention.

The embodiment shown in FIG. 3 differs from the FIG. 2 embodiment only in that the outside wall 12 has a localized convex area 18 whose convex side faces towards the inside of the cavity 11. This area is preferably obtained simply by localized stamping of the sheet metal constituting the outside wall 12. The stamped area 18 therefore degrades symmetry further, over and above the existing degraded symmetry when a pipe 4 is provided at another location in the cavity 11, as shown in FIG. 2.

Figure 4:
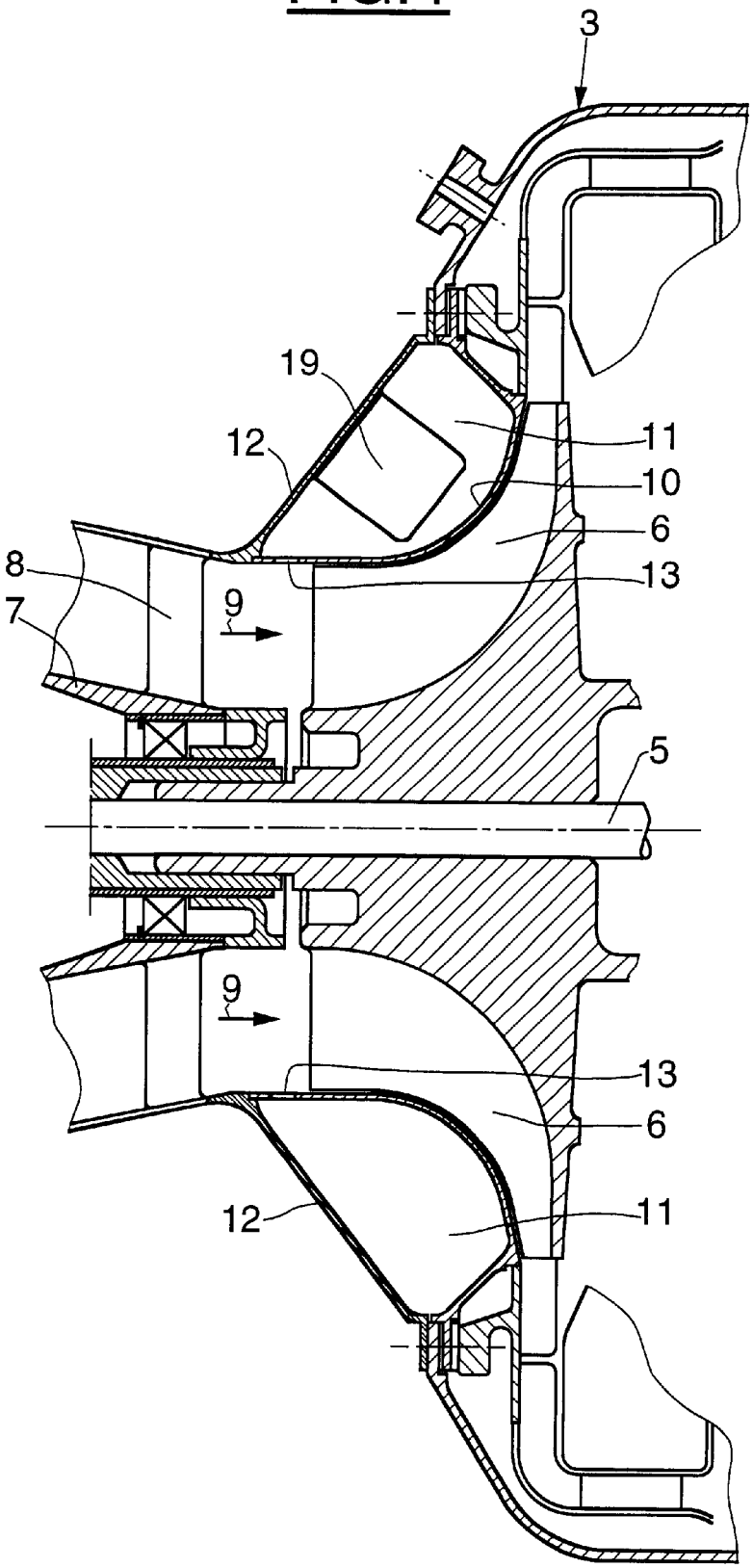
FIG. 4 is a sectional view similar to FIG. 2, showing a third embodiment of the invention.

The embodiment shown in FIG. 4 differs from the FIG. 3 embodiment in that a portion of sheet metal 19 disposed radially is welded to the inside face of the outside wall 12 of the cavity 11. The welded sheet metal portion 19 therefore projects into the cavity 11 and prevents the generation of rotating acoustical waves in the cavity 11. The pipe 4 can be at some other location in the cavity 11, of course. Note that the dimensions of the welded sheet metal portion 19, which is square in the embodiment shown by way of example in FIG. 4, are such that the welded sheet metal portion 19 extends from the outside wall 12 towards the inside wall 10 but without coming into contact with the latter. The welded sheet metal portion 19 can instead be fixed to the inside wall 10 and extend towards the outside wall 12.

Figure 5:
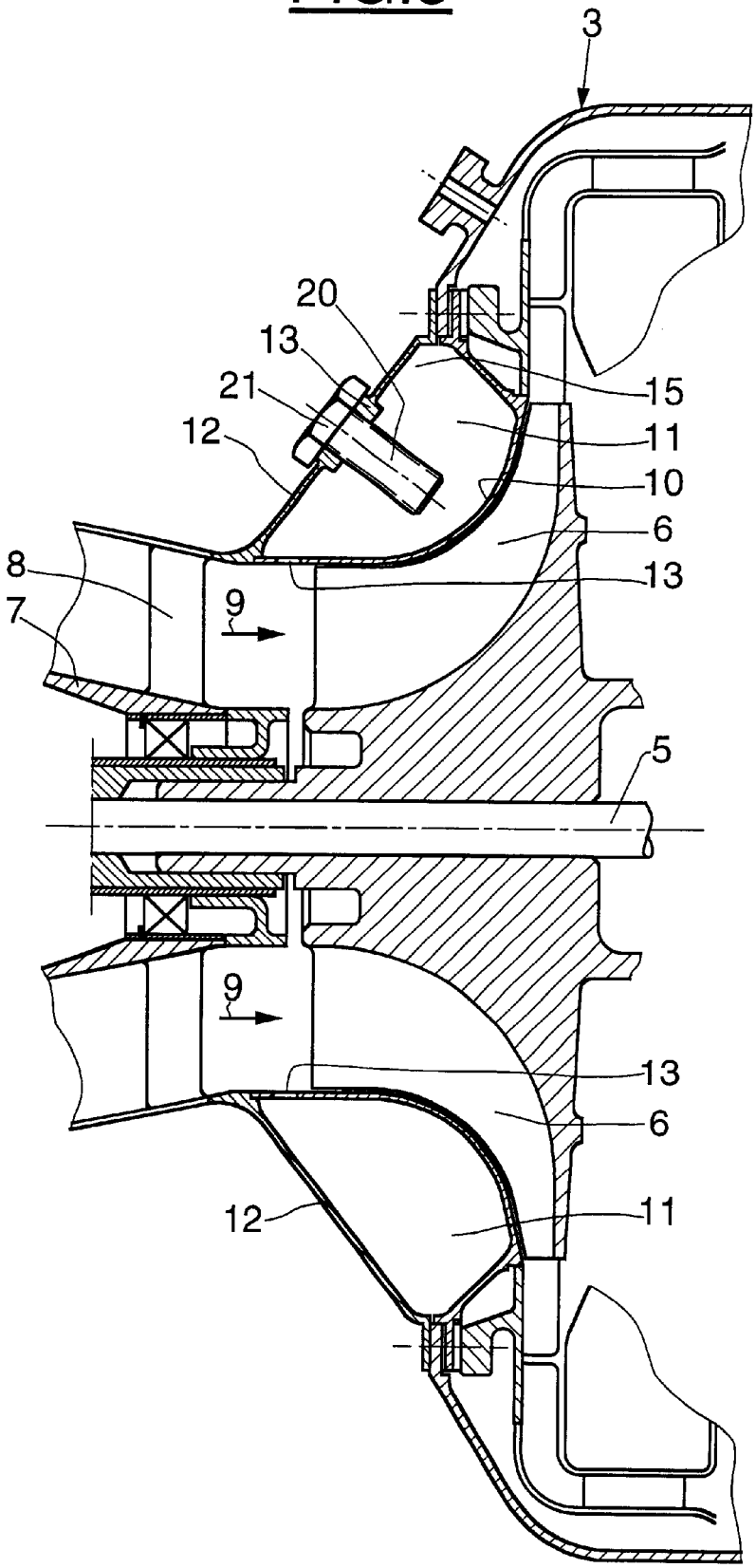
FIG. 5 is a sectional view similar to FIG. 2, showing a fourth embodiment of the invention.

The embodiment shown in FIG. 5 differs from the FIG. 4 embodiment in that a screw 20 passes through the outside wall 12 of the cavity 11 and projects a particular distance into said cavity 11. To facilitate mounting it, the outside wall 12 has an area 13 with a screwthread which can cooperate with the screwthread of the screw 20, whose head 21 remains outside the outside wall 12.

The dimensions of the screw 20 projecting into the cavity 11 are such that said screw extends towards the inside wall 10 in a radial plane without coming into contact with the inside wall 10.

In all the embodiments that have just been described by way of example, symmetry degrading means are therefore introduced into the symmetrical cavity to prevent the generation of rotating acoustical waves and thereby prevent resonance in the cavity, regardless of the flow speed in the turbomachine.

What is claimed is:

1. A turbomachine including a plurality of blade stages on the trajectory of a flow of air or gas delimited by a symmetrical wall along the axis of said turbomachine wherein said wall has orifices communicating with a cavity outside said flow of air of generally axially or cyclically symmetrical structure and symmetry degrading means are provided inside said cavity.

2. The turbomachine claimed in claim 1 wherein said symmetry degrading means include a spacer mounted in a pipe connected to said cavity to project partly into said cavity.

3. The turbomachine claimed in claim 2 wherein said spacer is force-fitted into said pipe.

4. The turbomachine claimed in claim 2 wherein said spacer is a portion of tube.

5. The turbomachine claimed in claim 1 wherein said symmetry degrading means include a convex localized area of said cavity having its convex side facing towards the inside of said cavity.

6. The turbomachine claimed in claim 5 wherein said convex area is obtained by localized stamping of said outside wall of said cavity.

7. The turbomachine claimed in claim 1 wherein said symmetry degrading means include a member fixed to the inside face of said outside wall of said cavity at a particular location.

8. The turbomachine claimed in claim 1 wherein said symmetry degrading means include a member fixed to the inside wall of said cavity at a particular location.

9. The turbomachine claimed in claim 7 wherein said member is a portion of sheet metal welded to the aforementioned wall of said cavity.

10. The turbomachine claimed in claim 1 wherein said symmetry degrading means include a screw passing through said outside wall of said cavity and projecting into said cavity.

* * * * *